US008555467B2

(12) United States Patent
Kelly

(10) Patent No.: US 8,555,467 B2
(45) Date of Patent: Oct. 15, 2013

(54) PULL TIGHT SEAL OR CABLE TIE WITH BREAK-AWAY TAIL

(75) Inventor: Martin Paul Kelly, Charlotte, NC (US)

(73) Assignee: Brooks Equipment Company, Inc., Charlotte, NC (US)

( * ) Notice: Subject to any disclaimer, the term of this patent is extended or adjusted under 35 U.S.C. 154(b) by 502 days.

(21) Appl. No.: 12/816,813

(22) Filed: Jun. 16, 2010

(65) Prior Publication Data

US 2011/0308047 A1 Dec. 22, 2011

(51) Int. Cl.
*B65D 63/10* (2006.01)

(52) U.S. Cl.
USPC ..... 24/16 PB; 292/307 R

(58) Field of Classification Search
None
See application file for complete search history.

(56) References Cited

U.S. PATENT DOCUMENTS 3,467,427 A * 9/1969 Moberg ..... 292/322
3,830,538 A * 8/1974 Moberg ..... 292/322
4,506,415 A * 3/1985 Swift ..... 24/16 PB
4,514,882 A * 5/1985 Lavielle ..... 24/16 PB
4,537,432 A * 8/1985 Meeks ..... 292/318
6,449,808 B1 * 9/2002 Zappa et al. ..... 24/16 PB
6,523,228 B1 2/2003 Benoit
6,928,701 B2 8/2005 Hutter, III
7,127,779 B2 10/2006 Hewes
7,281,302 B2 10/2007 Hewes
2008/0066265 A1 * 3/2008 Pilon et al. ..... 24/16 PB

* cited by examiner

*Primary Examiner* — Jack W. Lavinder
(74) *Attorney, Agent, or Firm* — Oblon, Spivak, McClelland, Maier & Neustadt, L.L.P.

(57) ABSTRACT

A flexible tie including a head having a first cross-sectional geometry and a tail extending from the head in a longitudinal direction and having a second cross-sectional geometry different from the first cross-sectional geometry. The tie includes a lock disposed on the head and including a passage configured to receive the tail and a plurality of barbs disposed on the tail and configured to pass through the passage in the lock in a first direction, and configured to be restricted from retreating through the passage in a second direction opposite to the first direction. The tie also includes a tail break-point disposed on the tail and including a first cross-sectional area, as viewed along the longitudinal direction, smaller than any other cross-sectional area of the tail as viewed along the longitudinal direction. In some configurations, the tie includes a visual indicator in the head.

20 Claims, 5 Drawing Sheets

PULL TIGHT SEAL OR CABLE TIE WITH BREAK-AWAY TAIL

BACKGROUND OF THE INVENTION

1. Field of the Invention

This invention relates to a pull tight seal or cable tie with a predetermined break-away position for removal of a tail. In one example, the invention relates to a pull tight seal including a tag or label for marking devices such as fire extinguishers or other containers.

2. Description of the Related Art

In conventional pull tight seals that are installed on devices, for example, fire extinguishers, the user wraps the pull tight seal around the device, and the user pulls a tail portion through a locking portion of the pull tight that locks barbs via a ratchet effect. The tail cannot be pulled backward through the lock due to the shape of the barbs, which allow motion through the lock in only one direction. A similar arrangement is provided for so-called "cable ties," and the term "tie" will be used to identify a group including both pull tight seals and cable ties.

In conventional ties, after fastening, part of the tail often protrudes from the end of the locking portion and can interfere with inspection of the tie after installation. Additionally, this unwieldy portion of the tail can get caught in other devices or seals when moving or using the device. This protruding portion of the tail is particularly problematic when the tie is installed in fire a extinguisher, which is often used in emergency situations.

SUMMARY OF THE INVENTION

Accordingly, one aspect of the present invention provides a flexible tie including a head having a first cross-sectional geometry and a tail extending from the head in a longitudinal direction and having a second cross-sectional geometry different from the first cross-sectional geometry. The tie includes a lock disposed on the head and including a passage configured to receive the tail and a plurality of barbs disposed on the tail and configured to pass through the passage in the lock in a first direction, and configured to be restricted from retreating through the passage in a second direction opposite to the first direction. The tie also includes a tail break-point disposed on the tail and including a first cross-sectional area, as viewed along the longitudinal direction, smaller than any other cross-sectional area of the tail as viewed along the longitudinal direction. In some configurations, the tie includes a visual indicator in the head.

BRIEF DESCRIPTION OF THE DRAWINGS

These and other advantages of the invention will become more apparent and more readily appreciated from the following detailed description of the exemplary embodiments of the invention taken in conjunction with the accompanying drawings where.

DETAILED DESCRIPTION OF THE PREFERRED EMBODIMENTS

Figure 1:
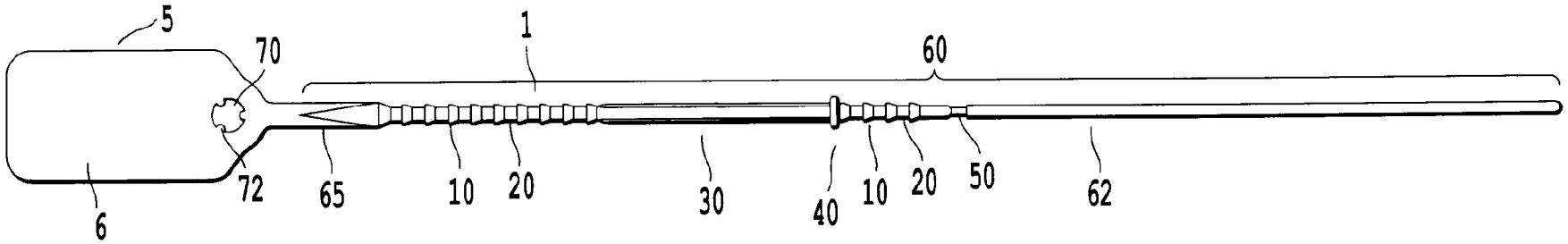
FIG. 1 is a top view of one example of the inventive tie.

Embodiments of the present invention will be described hereinafter with reference to the accompanying drawings. In the following description, the constituent elements having substantially the same function and arrangement are denoted by the same reference numerals, and repetitive descriptions will be made only when necessary.

Figure 2:
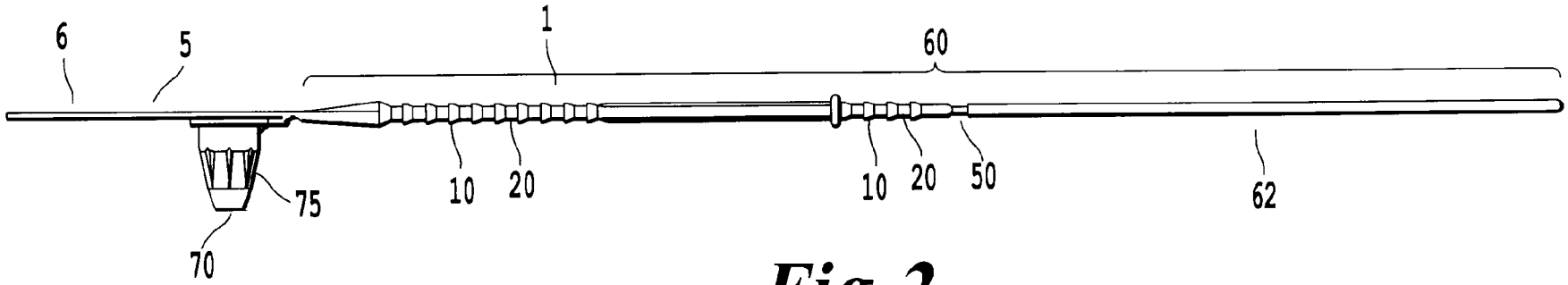
FIG. 2 is a front view of the tie shown in FIG. 1.
Figure 3:
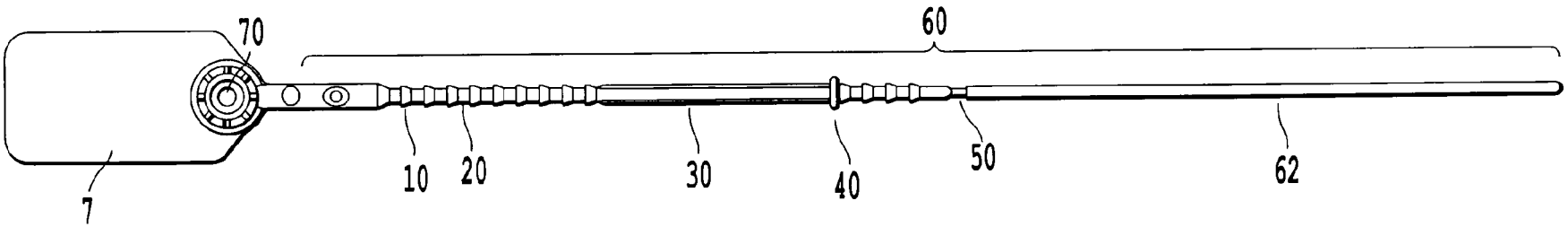
FIG. 3 is a bottom view of the tie shown in FIG. 1.

With reference to FIGS. 1-3, one example of the inventive tie 1 is shown in which a head 5 including a front side 6 and a back side 7 is connected to a tail 60 that has at least one different cross-sectional geometry from the cross-sectional geometry of the head 5. At least one of the front side 6 and back side 7 of the head 5 is typically configured to display or receive an informational visual indicator such as a writing, stamping, or sticker. In the example shown, a neck 65 occupies a portion of the tail 60 and serves to strengthen the connection between the head 5 and the tail 60. For example, as measured in the radial direction, the neck 65 can have larger dimensions than the tail 60. In some examples, the tail does not include the neck 65. The tie 1 can be formed of any of a variety of flexible materials, but plastics such as polypropylene are typically used. In some embodiments, the tie 1 is color-coded for a particular use. As would be familiar to a person of ordinary skill in the art, the tail 60 extends away from the head 5 in a longitudinal direction (to the right in FIG. 1) and is configured to bend around an object in order to be secured to the object when the tail is in a locked position.

The head 5 further includes a lock protrusion 75. The lock protrusion 75 includes a lock 70 and typically includes one or more tab 72 disposed on or near the lock 70. As shown in FIGS. 1-3, the lock protrusion 75 may be generally conical in shape. However, other shapes are possible.

As further shown in FIGS. 1-3 a series of barbs 10 are disposed on the tail 60. The barbs 10 are separated from each other by a series of core portions 20. As shown in FIGS. 1-3, the barbs 10 may be conical or shaped as a truncated cone. In one embodiment, the barbs 10 have a maximum (major) diameter of 0.085 inches and a cone angle of 15 degrees. In one example, there is a 0.07 inch distance from a perpendicular face corresponding to the major diameter of one of the barbs 10 and the conical portion of the next closest of the barbs 10. As the barbs 10 are made to slide into the lock 70, the conical or frustoconical shape assists in a ratcheting effect in which the barbs 10 pass through the lock 70 and are locked in place by the tab 72 so as to resist passing through the lock 70 in a direction opposite to that of entry. The core portions 20 typically have a major (outermost) diameter of approximately 0.06 inches, where "approximately" means plus or minus 0.01 inch. In some applications, the barbs 10 and/or core portions 20 are not round, but are instead oval, polygonal, or some other shape. In these cases, the minimum cross-sectional dimension is preferably 0.06 inches. However, with all of the above-noted dimensions, variations are available depending upon the need of the user.

Figure 10:
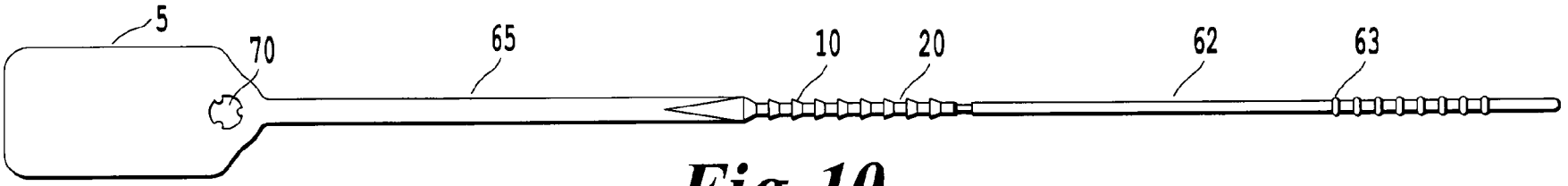
FIG. 10 is a top view of another example of the inventive tie.
Figure 11:
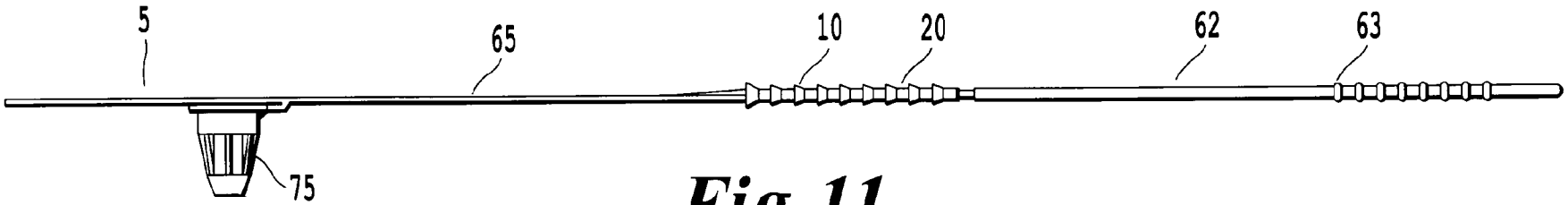
FIG. 11 is a front view of the tie shown in FIG. 10.
Figure 12:
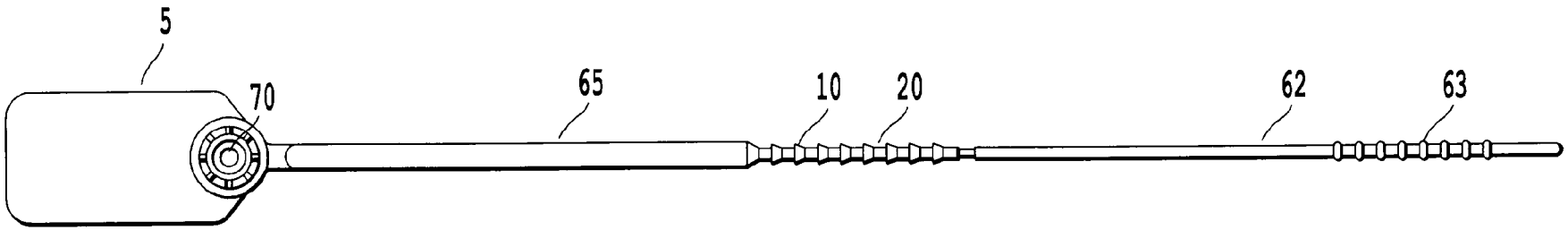
FIG. 12 is a front view of the tie shown in FIG. 10.
Figure 13:
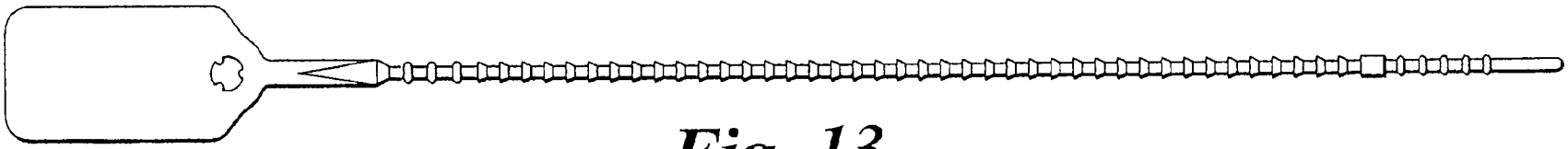
Fig. 13 CONVENTIONAL ART
FIG. 13 is a view of a conventional tie.

As shown in FIGS. 1-3, an optional intermediate grip 30 may be disposed on the tail 60 and serves to allow a user to comfortably grip the tail 60 without touching the barbs 10. In some embodiments, the intermediate grip 30 is omitted in order to simplify manufacture. In some embodiments, the intermediate grip 30 has a flattened cross-section (FIGS. 10-12) in order to allow a strong, but still flexible tie 1. In other words, the flattened intermediate grip 30 allows a preferred direction of bending, which can make inspection of the front side 6 and back side 7 of the head 5 easier. The intermediate grip 30 may be incorporated into any of the embodiments of the present invention disclosed herein.

Figure 4:
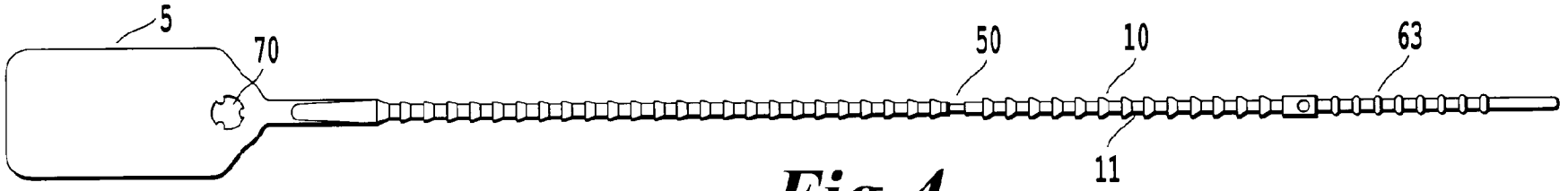
FIG. 4 is a top view of another example of the inventive tie.
Figure 5:
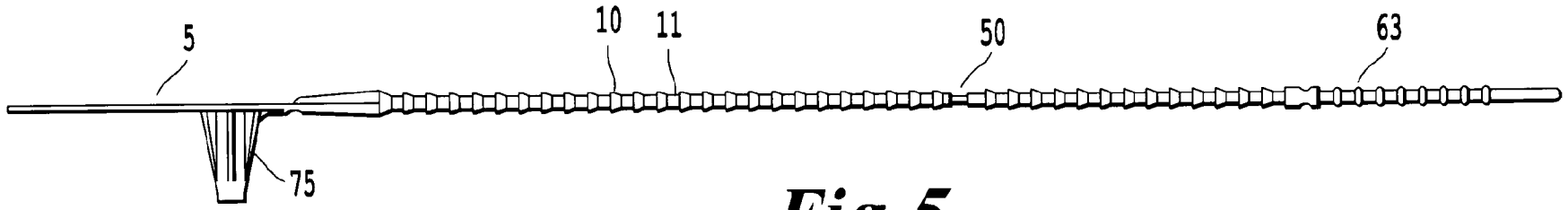
FIG. 5 is a front view of the tie shown in FIG. 4.
Figure 6:
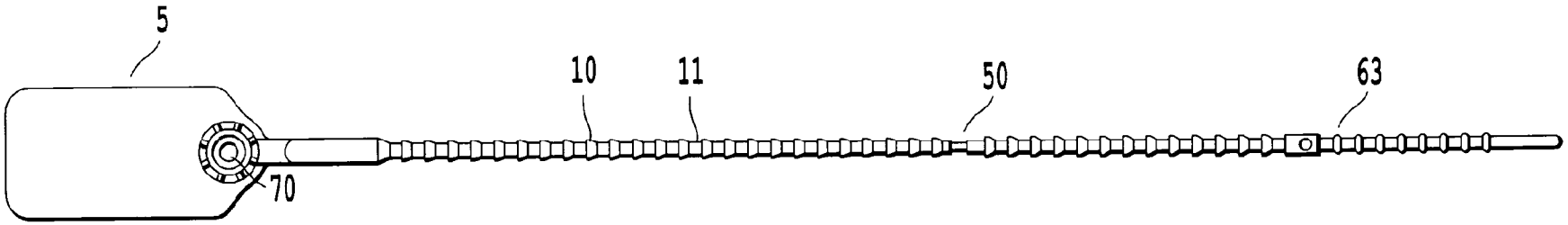
FIG. 6 is a bottom view of the tie shown in FIG. 4.
Figure 7:
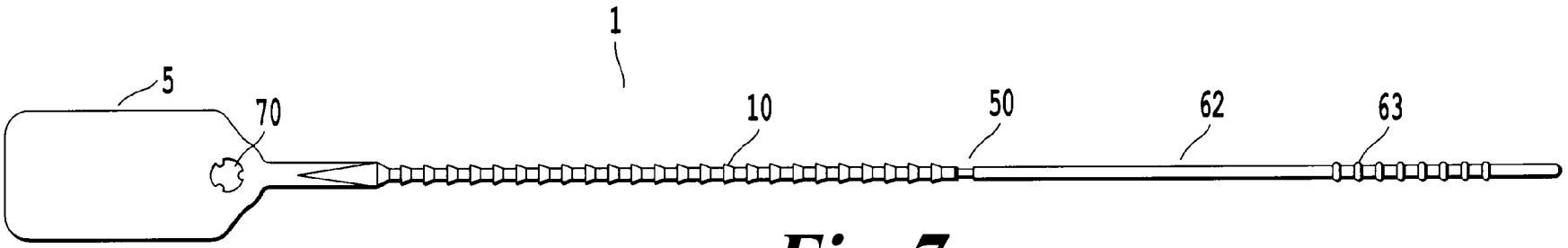
FIG. 7 is a top view of one example of the inventive tie.
Figure 8:
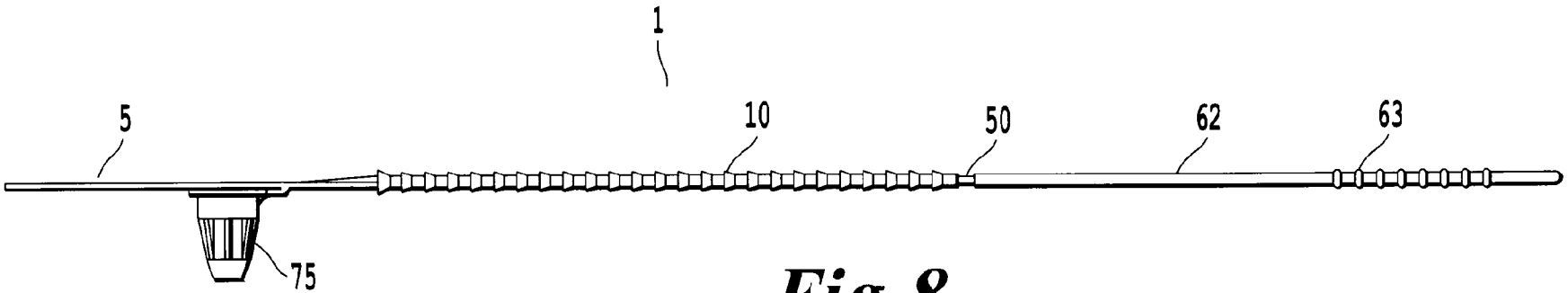
FIG. 8 is a front view of the tie shown in FIG. 7.
Figure 9:
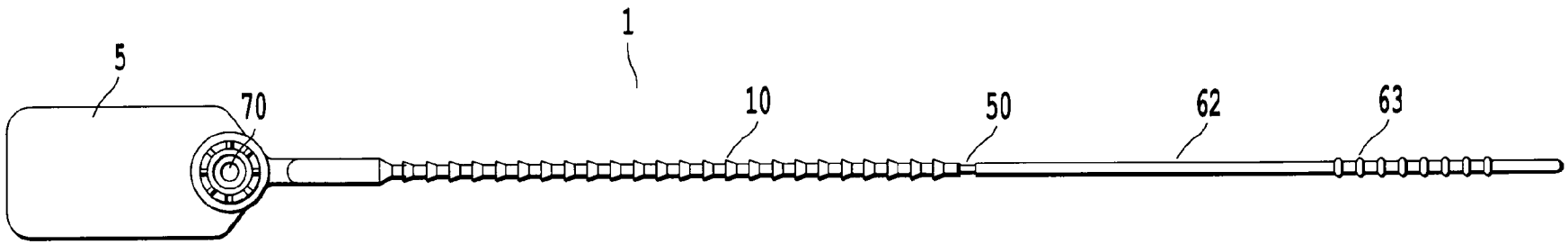
FIG. 9 is a bottom view of the tie shown in FIG. 7.

FIGS. 1-3 also depict an optional stopper 40, which may be used to stop movement of the tail 60 at a predetermined position and/or to prevent over-tightening. In some instances, it is preferable not to tighten the tail 60 to the extent that the loop formed by the tail 60 after the tail 60 passes through the lock 70 grabs the object around which the tail 60 is wrapped. For example, if the tie 1 is used to identify an inspection date for a fire extinguisher, it is generally preferable to allow easy inspection of the front side 6 and back side 7 by providing a loose connection between the tail 60 and the connection loop or orifice on the fire extinguisher. The loose connection allows the front side 6 and back side 7 to be examined without putting strain on the tail 60, and therefore assists in allowing the tail 60 to avoid wear and tear while it is attached to the fire extinguisher. FIGS. 4-5 depict examples without the optional stopper 40 or intermediate grip 30. FIGS. 7-9 depict examples without the stopper 40 and with grips 63 disposed on the disposable portion 62. The grips 63 typically have a diameter smaller than the diameter of the barbs 10 in order to allow smooth passage of the tail 60 through the lock 70. The grip 63 may be incorporated into any of the embodiments of the invention disclosed herein.

If the optional stopper 40 is disposed on the tail 60, then the barbs 10 disposed between the head 5 and the stopper 40 will typically be unused inasmuch as these barbs will not pass through the lock 70 during attachment. FIGS. 1-3 depict barbs between the stopper 40 and head 5 in order to show that the same tail 60 may be made to include or not include the stopper 40 depending on the needs of the user.

The barbs 10 disposed between the stopper 40 and the end of the tie 1 opposite the head 5 are used to secure the tie 1 in the lock 70. As shown in FIGS. 1-3, a predetermined break-away 50 is disposed on the tail 60. The predetermined break-away 50 is typically the physically weakest point on the tail 60 and allows a user to cleanly snap off the disposable portion 62 after the tail 60 is looped through the lock 70 and the item to which the tie 1 is attached. Preferably, the tensile force required to break the tail via the predetermined break-away 50, as measured by pulling straight down the length of the tie 1, is between four and eight pounds, while the force required to break the tail 60 without the predetermined break-away 50 is between seven and eleven pounds. Preferably, the force required to break the tail 60 at the predetermined break-away 50 is less than the force required to break the tail 60 without the predetermined break-away 50. Thus, the predetermined break-away 50 provides a convenient predetermined failure section allowing the user to know in advance of breaking exactly where the tail 60 of the tie 1 will break once sufficient tensile force is applied to the tie 1.

Preferably, the ratio of diameter of the predetermined break-away 50 to the diameter or largest dimension of the core portions 20 is 2/3 in order to allow a significant difference in tensile strength between these two components and to ensure that the predetermined break-away 50 breaks before any of the core portions 20 or other parts of the tail 60 break. Preferably, the outermost dimension or diameter of the predetermined break-away 50 is approximately 0.04 inches. Additionally, it is preferable that the predetermined break-away 50 be approximately 0.10 inches long in order to provide a visible indication of the break point to a user prior to breaking. It should be noted that in some embodiments, the cross-section of the tail is not circular. Similarly, in some embodiments, the cross-section of the predetermined break-away 50 is not circular. In examples where the cross-section of one or both of the tail 60 and predetermined break-away 50 is not circular, it is preferred that similar breakage characteristics are provided by the tail 60 and predetermined break-away 50 to those noted above regarding the 2/3 diameter. In other words, the ratio of cross-sectional area of the tail 60, in the direction the tail 60 extends from the head 5, is larger than the cross-sectional area of the predetermined break-away 50. Preferably, when one or more of the predetermined break-away 50 and tail 60 is non-circular, the ratio of the cross-sectional area of the predetermined break-away 50 to the minimum cross-sectional area of the tail 60 other than the predetermined break-away 50 is 4/9, just as it would be for circular cross-sections when the ratio of the diameters is 2/3.

As further shown in FIGS. 1-3, the tail 60 may include a disposable portion 62, which can be gripped by the user and inserted into the lock 70. In other embodiments, the barbs 10 extend across the area occupied by the disposable portion 62 in FIGS. 1-3.

In practice, the user wraps the tie 1 around an object to be secured or tagged, and the user pulls the tail 60 through the lock 70 until at least one of the barbs 10 are locked by the tab 72. Due to the shape of the barbs 10, the barbs 10 cannot be easily pulled back through the lock 70, and the tie 1 is permanently wrapped around the object until the tie 1 is cut or otherwise damaged. If the optional stopper 40 is present, the user will typically pull the tail 60 until it "bottoms out" on the stopper 40. At this point, or when the tie grips the object if no stopper is present, the user pulls with greater force, and the tail 60 will break at the predetermined break-away 50 while leaving no portion, or only a short stub, of the tail 60 protruding from the lock 70. Thus, the predetermined break-away 50 allows a clean break to be formed without an unwieldy portion of the tail 60 dangling from the lock 70, which could get caught or tangled on other objects. This clean break is particularly helpful when tagging fire extinguishers as these are often handled during emergency situations.

Although only certain embodiments of this invention have been described in detail above, those skilled in the art will readily appreciate that many modifications are possible in the exemplary embodiment without materially departing from the novel teachings and advantages of this invention. Accordingly, all such modifications are intended to be included within the scope of this invention.

The invention claimed is:

1. A flexible tie comprising:

a head having a first cross-sectional geometry;

a tail extending from the head in a longitudinal direction and having a second cross-sectional geometry different from the first cross-sectional geometry;

a lock disposed on the head and including a passage configured to receive the tail;

a plurality of barbs disposed on the tail and configured to pass through the passage in the lock in a first direction, and configured to be restricted from retreating through the passage in a second direction opposite to the first direction, each barb being separated longitudinally from adjacent barbs via a core section of the tail; and a tail break-point disposed on the tail and including a cross-sectional area, as viewed along the longitudinal direction, smaller than any other cross-sectional area of the tail as viewed along the longitudinal direction, a length of the tail break-point being longer than a length of the core section between adjacent barbs, wherein the tail break-point is an annular groove having the cross-sectional area extending from a first portion of the tail having a first cross-section to a second portion of the tail having a second cross-section, the cross-sectional area of the tail break-point being smaller than both the first and second cross-sections of the respective first and second portions of the tail.

2. The flexible tie of claim 1, wherein more than one of the barbs disposed on the tail are at least partially conical in shape.

3. The flexible tie of claim 2, wherein a ratio of the cross-sectional area of the tail break-point to the minimum cross-sectional area of a remainder of the tail is 4/9.

4. The flexible tie of claim 3, wherein the cross-sectional area of the tail break-point and the cross-sectional area of the remainder of the tail are both circular.

5. The flexible tie of claim 1, further including grip protrusions extending from the tail in a radial direction perpendicular to the longitudinal direction.

6. The flexible tie of claim 1, wherein the tail comprises polypropylene.

7. The flexible tie of claim 1, further comprising a stopper disposed on the tail between at least one of the barbs and the head.

8. The flexible tie of claim 7, wherein at least one of the barbs is disposed between the tail break-point and the stopper.

9. The flexible tie of claim 1, wherein the tail break-point is disposed between the at least one of the barbs and grip protrusions extending from the tail in a radial direction different from the longitudinal direction.

10. The flexible tie of claim 9, wherein the grip protrusions have a maximum diameter less than a maximum diameter of the plurality of barbs.

11. The flexible tie of claim 1, wherein a minimum tensile force in the longitudinal direction required to break the tail in an area other than the predetermined break point ranges from 7 to 11 lbs.

12. The flexible tie of claim 11, wherein a minimum tensile force in the longitudinal direction required to break the predetermined tail break point ranges from 4 to 8 lbs.

13. The flexible tie of claim 12, wherein the minimum tensile force in the longitudinal direction required to break the predetermined tail break point is less than the minimum tensile force in the longitudinal direction required to break the tail in an area other than the predetermined break point.

14. The flexible tie of claim 1, wherein a bending moment required to bend the tail about a first axis perpendicular to the longitudinal direction is greater than a bending moment required to bend the tail about a second axis perpendicular to the longitudinal direction and perpendicular to the first axis.

15. A flexible tie comprising:

a head having a first cross-sectional geometry and configured to display at least one visual indicator on at least one side;

a tail extending from the head in a longitudinal direction and having a second cross-sectional geometry different from the first cross-sectional geometry;

a lock disposed on the head and including a passage configured to receive the tail;

a plurality of barbs disposed on the tail and configured to pass through the passage in the lock in a first direction, and configured to be restricted from retreating through the passage in a second direction opposite to the first direction, each barb being separated longitudinally from adjacent barbs via a core section of the tail; and a tail break-point disposed on the tail and including a cross-sectional area, as viewed along the longitudinal direction, smaller than any other cross-sectional area of the tail as viewed along the longitudinal direction, a length of the tail break-point being longer than a length of the core section between adjacent barbs, wherein the tail break-point is an annular groove having the cross-sectional area extending from a first portion of the tail having a first cross-section to a second portion of the tail having a second cross-section, the cross-sectional area of the tail break-point being smaller than both the first and second cross-sections of the respective first and second portions of the tail.

16. The flexible tie of claim 15, wherein the visual indicator is at least one of a sticker, writing, or stamping.

17. The flexible tie of claim 15, wherein a ratio of the cross-sectional area of the tail break-point to the minimum cross-sectional area of a remainder of the tail is 4/9.

18. The flexible tie of claim 17, wherein the cross-sectional area of the tail break-point and the cross-sectional area of the remainder of the tail are both circular.

19. The flexible tie of claim 15, further including grip protrusions extending from the tail in a radial direction perpendicular to the longitudinal direction.

20. The flexible tie of claim 15, wherein a bending moment required to bend the tail about a first axis perpendicular to the longitudinal direction is greater than a bending moment required to bend the tail about a second axis perpendicular to the longitudinal direction and perpendicular to the first axis.

* * * * *